US005263919A

United States Patent [19]

Hollenback

[11] Patent Number: 5,263,919

[45] Date of Patent: Nov. 23, 1993

[54] SINGLE LEG SQUAT MACHINE

[76] Inventor: George M. Hollenback, 5401 Rampart #414, Houston, Tex. 77081

[21] Appl. No.: 974,882

[22] Filed: Nov. 12, 1992

[51] Int. Cl.[5] ..... A63B 26/00

[52] U.S. Cl. ..... 482/145; 482/94; 482/142

[58] Field of Search ..... 482/104, 72, 93, 94, 482/142, 148, 145

[56] References Cited

U.S. PATENT DOCUMENTS

| | | | |
|---|---|---|---|
| D. 256,707 | 9/1980 | MacLaren-Taylor | 482/142 |
| 3,892,404 | 7/1975 | Martucci | 482/145 |
| 4,046,373 | 9/1977 | Kim | 482/145 |
| 4,634,119 | 1/1987 | Pesthy | 482/145 |
| 4,762,363 | 8/1988 | Hart | 482/72 |
| 4,848,740 | 7/1989 | Van Der Hoeven | 482/145 |
| 5,066,005 | 11/1991 | Lueke | 482/145 |
| 5,169,363 | 12/1992 | Campanaro et al. | 482/142 |

OTHER PUBLICATIONS

Angel Spassov and Terry Todd, "More Bulgarian Leg Training," *Muscle & Fitness*, Oct. 1990, p. 110.

Robert C. Hoffman, *Weight Training for Athletes* (New York: Ronald Press, 1961), pp. 127 and 129.

Dianne Holum, "Power Legs," *Shape*, Nov. 1992, p. 69.

*Primary Examiner*—Richard J. Apley

*Assistant Examiner*—Lynne A. Reichard

[57] ABSTRACT

An adjustable, elevated platform structure having a T-shaped planform. The upright of the T is a rail (10) on which is mounted a sled (58) carrying an elevated, oblong forward platform (54). The crossbar (12) of the T sports two vertical supports (14) which hold up the ends of an oblong, vertically oriented rear platform (24). A cushioned instep support (42, 44) is mounted across the forward facing side of the rear platform. The forward platform can be moved back and forth along the rail, the rear platform can be moved up and down on the vertical supports, and the cushioned instep support can be moved closer to or further away from the forward facing side of the rear platform. The user places his leading foot (74) on the forward platform and inserts the toe of his trailing foot (76) between the rear platform and the cushioned instep support. Keeping all his weight evenly distributed over the leading foot, the user squats down as far as he can go on his leading leg (70), then pushed himself back up with the leading leg.

12 Claims, 5 Drawing Sheets

SINGLE LEG SQUAT MACHINE

CROSS-REFERENCE TO RELATED APPLICATION

This application is related to application Ser. No. 07/866,086 filed Apr. 6, 1992.

1. Field of Invention

This invention relates to leg exercise apparatus, especially leg exercise apparatus that enables its user to perform free-standing genuflectory movements.

2. Description of Prior Art

The barbell squat has a well-deserved reputation as the best all-round leg developing exercise. It works the main muscle groups through a relatively full range of motion, and, because it is a freestanding movement, calls into play a number of other muscles that stabilize the exerciser to keep him from losing his balance.

Unfortunately, however, this otherwise perfect exercise has one inherent shortcoming: Because the weight bearing capacity of the legs usually exceeds the weight bearing capacity of the back, optimal exercise resistance loads for the legs are often too much for the back to support without strain or injury.

One way of circumventing this problem is by performing the squatting movement on only one leg at a time instead of on both legs simultaneously. Working each leg separately requires a much lower resistance load, thereby lessening the strain on the back. In fact, performing a single leg squat exercise with no additional resistance subjects the exercised leg to almost as much stress as performing a two-legged squat with a barbell carrying the equivalent of the exerciser's bodyweight-yet with no more stress to the back than that experienced while standing or walking.

There are three basic types of single leg squat movements:

1) Sitting. The exerciser lowers himself down on one leg while keeping the other leg extended horizontally in front of him. He then pushes himself back up. At the bottom of the movement, the exerciser looks as if he is sitting with one leg extended and the other drawn up to his chest. Unfortunately, however, the movement is so awkward and difficult that most people cannot perform a single repetition.

2) Stepping. The exerciser places one foot on the top of a bench, then repeatedly steps up onto the bench and lowers himself back down again, all the while keeping the one foot planted on the same spot. Although this is an excellent exercise, stability and consistency can be a problem because the exerciser sometimes experiences difficulty staying balanced on one leg while the other leg is not in contact with either bench or floor.

3) Kneeling. The exerciser stands with all his weight on one leg, the other leg extended behind him with the toes lightly resting on a platform a few inches above floor level. Keeping his weight on the one leg, he lowers himself down until the knee of the other leg almost touches the floor, then pushes himself back up. This movement is more stable than the previous two because the exerciser can use his other leg to balance himself; its range of motion, however, is seriously diminished because the floor interferes with the downward travel of the knee.

If the "kneeling" type of single leg squatting movement could be performed atop some kind of elevated platform that allowed the knee to descend without hitting the floor, the result would be an exercise possessing three distinct advantages over the barbell squat:

1) greater range of motion;
2) greater involvement of stabilizing muscles (even with the stabilizing influence of the trailing leg, the "kneeling" type of single leg squat requires more balance than the barbell squat); and
3) drastically reduced strain to the back.

OBJECTS AND ADVANTAGES

Accordingly we claim the following as our objects and advantages of the invention: to provide an exercise apparatus enabling the user to perform freestanding single leg squat movements of the "kneeling" type through a full range of motion with a minimum of stress to the back.

In addition to providing a safe alternative to the barbell squat for bodybuilders and other weight training enthusiasts, the single leg squat also provides a means of training for "unilateral" sports specific moves which involve the independent action of one leg relative to the other. Sprinters, hurdlers, jumpers, speed skaters, and throwing events specialists all perform explosive, independent leg extension movements.

Sports medicine practitioners may prescribe single leg squats for back-injured athletes who ordinarily perform barbell squats. Physical therapists may prescribe single leg squats for those whose legs are asymmetrical in development because of injury or physical defect.

DRAWING FIGURES

DRAWING REFERENCE NUMERALS

Figure 1:
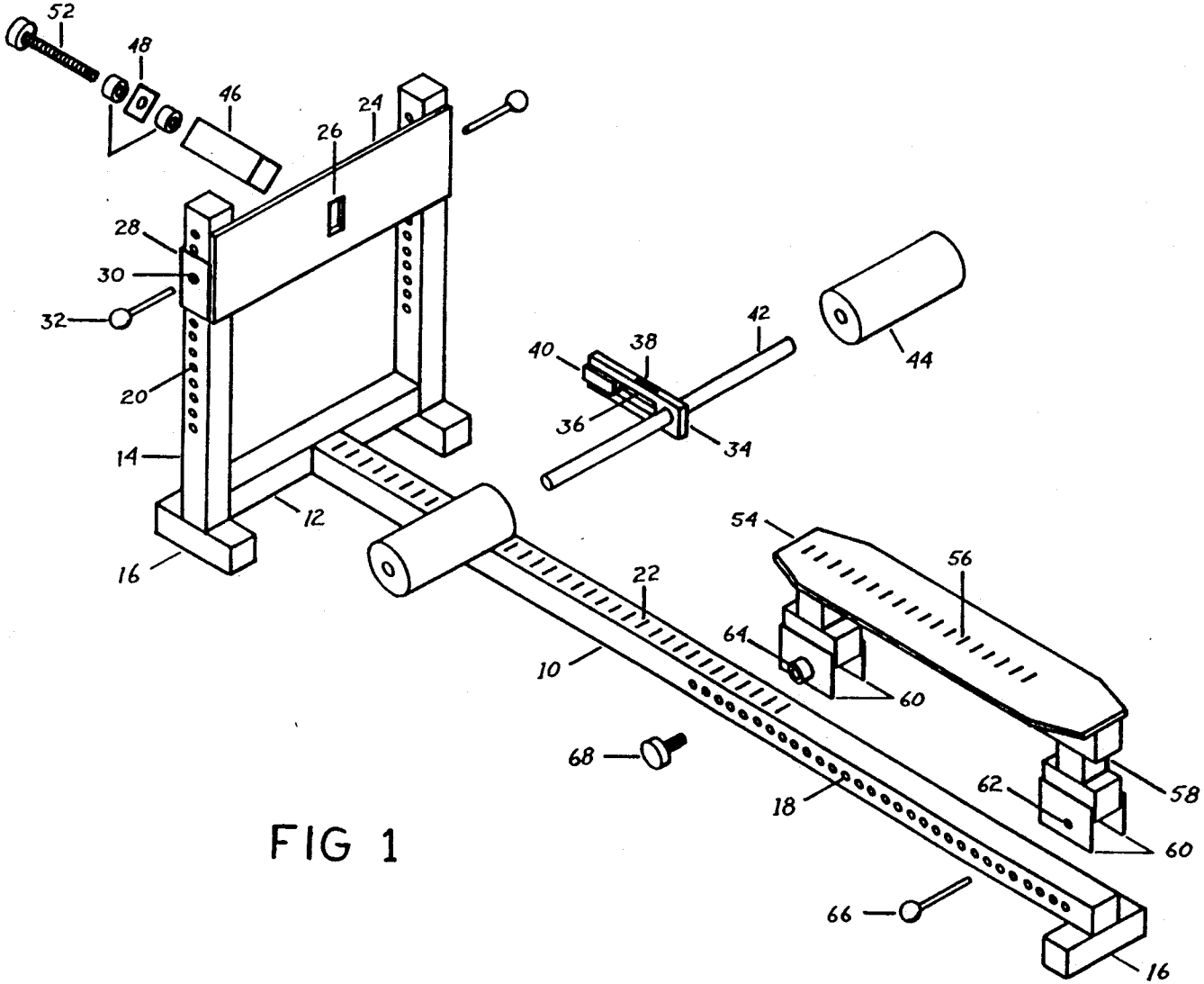
FIG. 1 shows a partially exploded isometric view of an exercise apparatus according to the invention.

10 rail
12 crossbar
14 vertical support
16 riser
18 rail holes
20 vertical support holes
22 incremental rail markings
24 rear platform
26 rear platform slot
28 sleeve
30 sleeve hole
32 sleeve lock pin
34 strut
36 strut slot
38 incremental strut markings
40 tapped block
42 instep support
44 instep cushion
46 housing
48 cap
50 collars
52 housing screw
54 forward platform
56 incremental forward platform markings
58 sled 60 flaps
62 flap hole
64 tapped opening
66 sled lock pin
68 sled screw
70 leading leg
72 trailing leg
74 leading foot
76 trailing foot

DESCRIPTION

FIG. 1 shows an exercise apparatus according to the preferred embodiment of the invention. The apparatus is supported by a welded framework of eleven gauge 2" square tubular steel comprising a 60" rail 10, a 14" crossbar 12 at the end of the rail, and two 21½" vertical supports 14 at opposite ends of the crossbar. The rail and the vertical supports have strings of holes 18, 20 bored in them for the insertion of lock pins 66, 32. Short 6" sections are positioned as risers 16 under the vertical supports and at the end of the rail.

The rear platform 24 is ¼"×6"×18" floor plate with a 1¼"×2¼" vertical slot 26 cut in the middle. Sleeves 28 of 2¼" square tubular stock 4" long are welded onto the back to fit over the vertical supports. Both sleeves have holes 30 for lock pins that secure the sleeves to the vertical supports.

A 4⅛" housing 46 of 2" square tubular steel has one end welded corner to corner over the slot on the back of the rear platform. The other end is surmounted by a cap 48 with a ¾" hole in the center. A 6" screw 52 with ¾" acme thread is inserted 4⅛" into the housing through this hole and held fast by collars 50 that sandwich the cap between them.

The 7⅜" strut 34 is made from ½"×2.05" bar and has a 1¼"×4⅛" slot 36 into whose open end is welded a block 40 bored and tapped for ¾" acme thread. There is a 1" hole centered 1" from the tip of the strut into which is welded a 1"×18" section of round stock, the instep support 42. Sponge rubber roller cushions 44 are slid onto each end of the instep support. The back end of the strut is inserted into the rear platform slot where the screw engages the block. Rotating the head of the screw moves the strut forward and backward, into and out of, the housing.

The sled 58 is also made of 2" tubular stock. Two 4" sections lie on top of the rail and are held in line by θ"×3"×4" plate steel flaps 60 welded to the sides of the 4" sections. One flap has a hole 62 for a lockpin that secures the sled to the rail. Another flap has a tapped opening 64 to receive a screw 68 that is tightened to prevent the sled from wobbling. The 4" sections are surmounted by 1⅜" columns which support a 24" crosspiece. The forward platform 54, cut from θ"×5½"×24" plate steel, is welded lengthwise onto this crosspiece.

Series of incremental markings are scored lengthwise down the dorsal surfaces of the rail, the forward platform, and the strut. The rail markings 22 and forward platform markings 56 begin with "0" at the extreme rear end of each structure and run forward in 1" increments. The strut markings 38 are arranged in 1/16" or ⅛" increments to indicate the distance between the rear platform and the instep cushion as the strut is moved in and out of the rear platform slot.

While the above description contains many specificities, the reader should not construe these as limitations on the scope of the invention, but merely as exemplifications of preferred embodiments thereof. For example, skilled artisans will readily be able to change the dimensions, shapes, and materials of the various embodiments. They can employ any number of different means to regulate the disposition of the platforms and the adjustment of the strut. They can also combine the various embodiments with various means of resistance and support systems such as barbell racks, safety hand rails, and the like.

OPERATION

Figure 3:
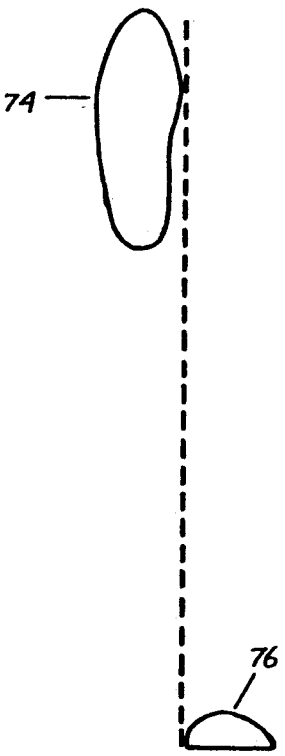
FIGS. 2 and 3 show the correct positioning of the user on such apparatus.
Figure 2:
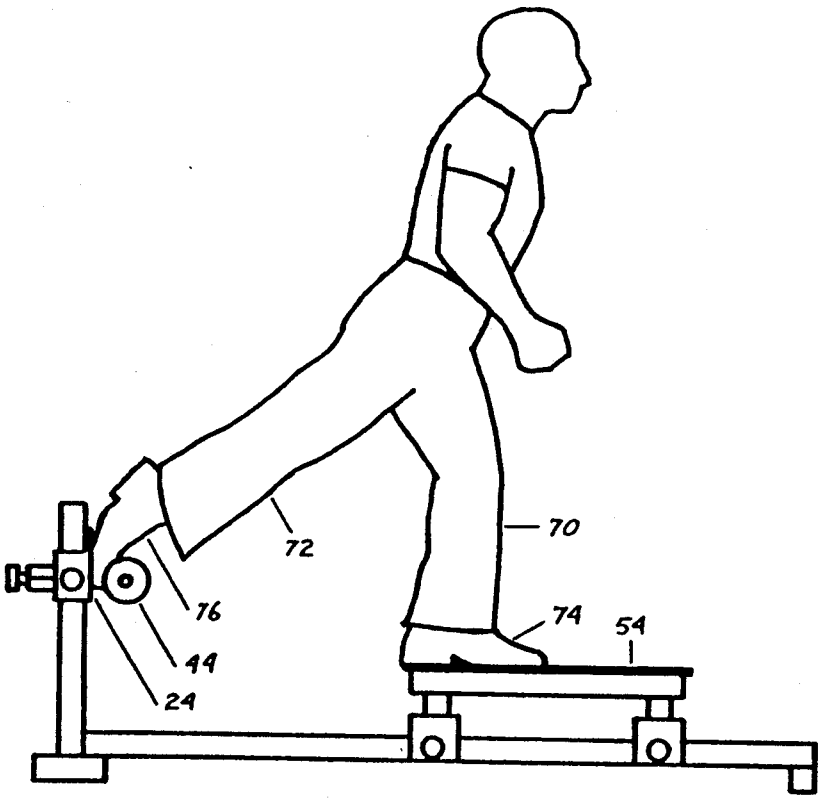

The user begins the exercise from the position shown in FIGS. 2 and 3. He stands erect, shoulders squared and facing forward, leading leg 70 slightly bent, nearly all of bodyweight evenly distributed over leading foot 74 and heel of leading foot flush with the rear edge of the forward platform 54. The trailing leg 72 and instep of trailing foot 76 extend straight back where the toe is inserted between the rear platform 24 and the instep cushion 44. The lateral portion of the ball of each foot should be touching an imaginary vertical plane as shown in FIG. 3.

The distance between the rear platform and the instep cushion should be adjusted so as to comfortably but firmly hold the end of the toe of the trailing foot. The rear platform should be elevated so that the vertical distance between the horizontal axis of the instep cushion and the plane of the forward platform is approximately equal to one-tenth the user's height.

Figure 6:
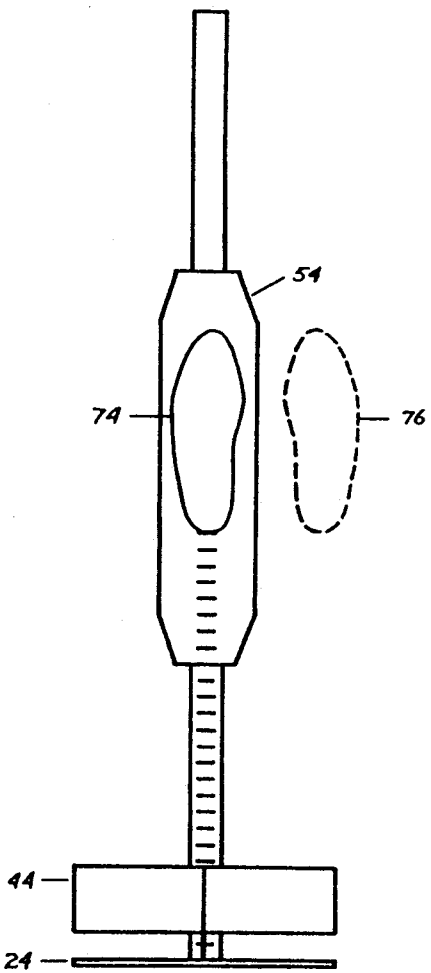
FIGS. 4 through 10 show the sequence of steps required to achieve the correct positioning of the user on such apparatus.
Figure 5:
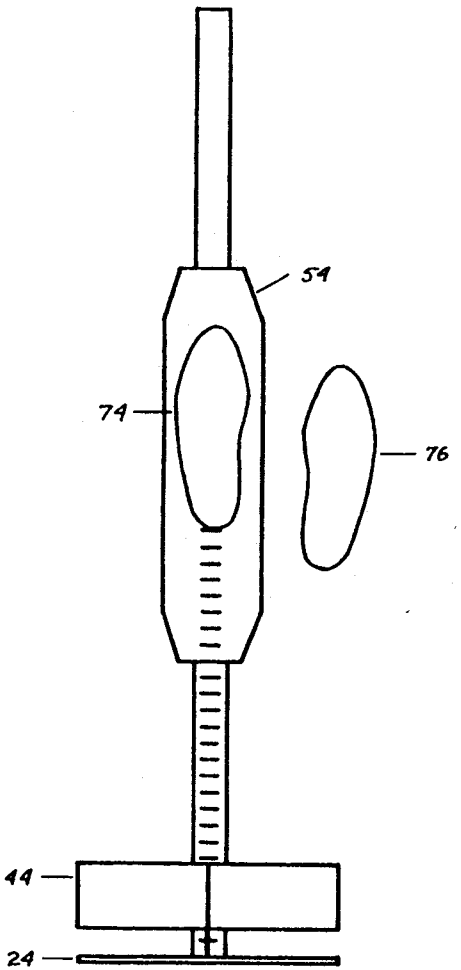
Figure 4:
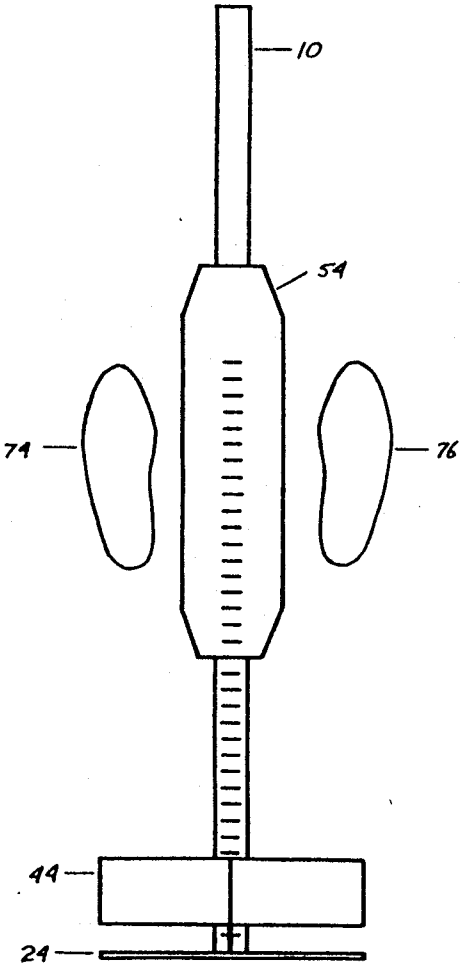
Figures 7, 8, 9, 10:
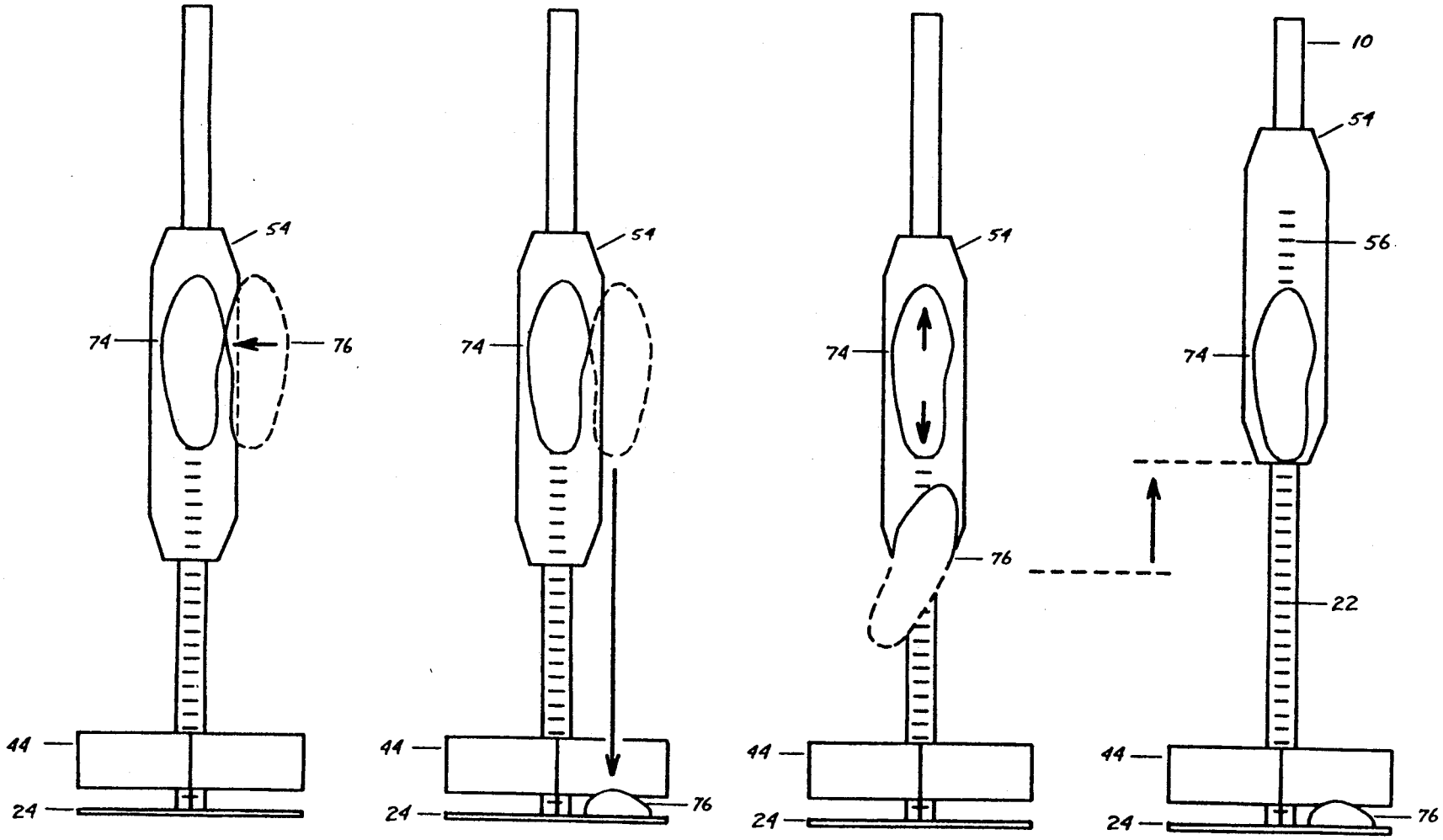

The correct positioning of the forward platform 54 involves some trial and error. The forward platform is initially positioned in the center of the rail 10. The user straddles it (FIG. 4), then places his leading foot 74 atop is slightly forward of center (FIG. 5). He then steps up onto the platform, all his weight now on the leading foot, the trailing foot 76 dangling in midair out to the side (FIG. 6). The user brings the trailing foot in beside the leading foot (FIG. 7), then shoots it straight back and inserts the toe between the instep cushion and the rear platform (FIG. 8). If the user feels himself being pulled slightly backward, his leading foot is too far out on the forward platform and needs to be brought back in; if he feels himself being pushed slightly forward, his leading foot is too far in on the forward platform and needs to be moved further out. In order to move the leading foot forward or backward, the user disengages the trailing foot and brings it down onto the forward platform behind the leading foot (FIG. 9). After shifting his weight to the ball of the trailing foot, the user scoots his leading foot forward or backward as required (FIG. 9), then repeats the step in FIG. 8. When he finally attains the correct position, he moves the forward platform ahead until its rear edge is flush with the positioning of his heel (FIG. 10).

The incremental markings 22, 56 beginning at "0" at the rear of both rail and forward platform and running forward in one inch increments, greatly aid in the last above mentioned step. In FIGS. 4 through 9, the rear edge of the centered platform is even with the 18" mark on the rail. The user, having found the correct placement for his leading foot, notes that his heel is even with the 8" on the forward platform. Since 18+8=26, the user moves the forward platform ahead so that its rear edge is now even with the 26" mark on the rail (FIG. 10). The user simply remembers to position the rear edge of the forward platform at the 26" mark every time he exercises and can skip the steps shown in FIGS. 4 through 9.

Figure 13:
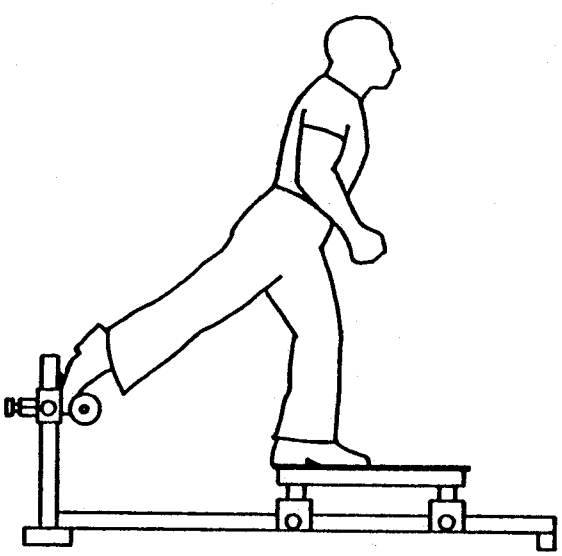
FIGS. 11 through 13 show the user performing a single leg squat beginning from the correct position and returning to the correct position.
Figure 12:
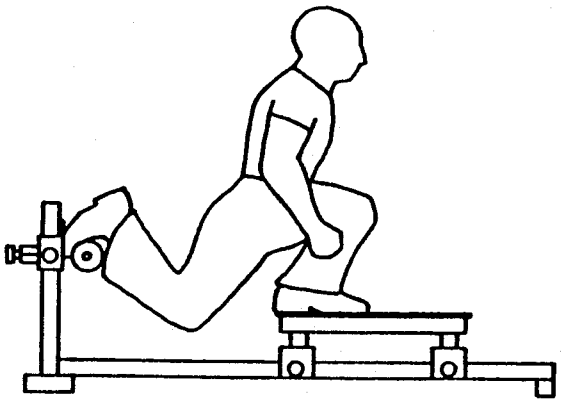
Figure 11:
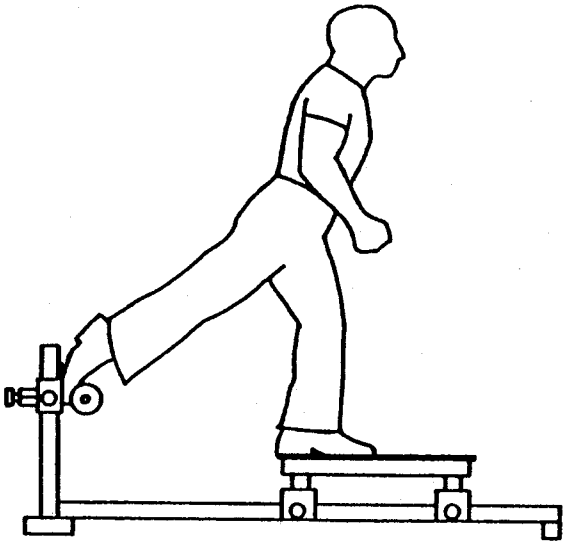

After having assumed the correct starting position, the user lowers himself down on the leading leg, all the while keeping his bodyweight evenly distributed over the leading foot. The knee of the trailing leg may descend well below the plane of the forward platform. The user than pushes himself back up on the leading leg, still keeping his bodyweight evenly distributed over the leading foot, until he once again reaches the original starting position (FIGS. 11 through 13).

I claim:

1. A leg exercise apparatus comprising a rail lying in a horizontal plane, said rail having a forward end and a backward end;

a crossbar lying in said horizontal plane, said crossbar perpendicularly attached at its midpoint to backward end of said rail;

a pair of elongated vertical support members, attached at their lower ends to opposite ends of said crossbar;

the ratio of lengths of said vertical support members to said crossbar being at least one to one but no greater than two to one;

the ratio of lengths of said rail to said crossbar being at least three to one;

an elongated sled slidably mounted lengthwise on said rail;

a means for securing said sled to said rail throughout a range of intervals along said rail;

an oblong forward platform lying in a horizontal plane and having a length to width ratio of at least four to one, said platform mounted atop said sled such that the longitudinal axes of said platform and said rail are both contained in the same vertical plane;

the ratio of lengths of said rail to said forward platform being at least two to one;

the vertical distance between the surface of said forward platform and the surface on which said apparatus rests being between one fifteenth to one fourth the length of said rail;

an oblong rear platform whose longitudinal axis lies in a horizontal plane, said platform lying in a substantially vertical orientation and having a length to width ratio of at least two to one;

a means for securing said rear platform to said vertical support members throughout a range of elevations along said vertical support members;

a slot in said rear platform, the center of said slot equidistant from the ends of said rear platform;

an elongated horizontal strut extending through said slot, the longitudinal axis of said strut lying in the vertical plane that contains the longitudinal axis of said rail;

a means for moving said strut forward and backward through said slot, said means located on the backward side of said rear platform;

an elongated instep rest attached at its midpoint to the forward end of said strut, the longitudinal axis of said instep rest parallel to the longitudinal axis of said rear platform, the length of said instep rest approximating the length of said rear platform; and one or more cushions mounted on said instep rest.

2. The apparatus of claim 1 wherein said means for securing said sled to said rail comprises a horizontal sequence of evenly spaced holes in one or both sides of said rail;

at least two rigid flaps extending downward from opposite sides of said sled and lying flush against sides of said rail;

a hole in the side of at least one of said flaps that corresponds to holes in said rail; and a lock pin inserted through aligned holes in said flap and rail.

3. The apparatus of claim 1 wherein said means for securing said sled to said rail comprises at least two rigid flaps extending downward from opposite sides of said sled and lying flush against sides of said rail;

a tapped opening in the side of one of said flaps; and a screw whose end can be tensioned against said rail through said tapped opening.

4. The apparatus of claim 2 further including a tapped opening in the side of one of said flaps and a screw whose end can be tensioned against said rail through said tapped opening.

5. The apparatus of claim 1 wherein said means for securing said rear platform to said vertical support members comprises a vertical sequence of evenly spaced holes in said support members;

a pair of vertically oriented sleeves attached to ends of said rear platform and slidably mounted on said vertical support members;

at least one hole in each sleeve corresponding to said holes in said support members; and a lock pin inserted through aligned holes in said sleeves and vertical support members.

6. The apparatus of claim 1 wherein said means for moving said strut forward and backward comprises a bored and tapped block attached to the backward end of said strut, the axis of the bore of said block congruent with the longitudinal axis of said strut;

a screw engaging said block;

a housing containing said block and screw; and a means for holding said screw that allows said screw to be rotated without travelling forward or backward.

7. The apparatus of claim 6 wherein said means for holding said screw comprises a fixed housing cap through which said screw is inserted, and collars on either side of said cap which hold said screw fast.

8. The apparatus of claim 6 wherein said housing comprises tubular stock of diamond shaped cross section, the opposite vertices of said diamond shaped cross section lying in horizontal and vertical planes;

said strut is of oblong, vertically oriented cross section, having a horizontally oriented lengthwise slot opening to the rear; and said tapped block is contained in said slot.

9. The apparatus of claim 1 further including a series of incremental markings running lengthwise on said rail, and another series of incremental markings running lengthwise on said forward platform.

10. The apparatus of claim 1 further including a series of incremental markings running lengthwise on the dorsal surface of said strut.

11. The apparatus of claim 1 wherein said instep rest is of circular cross section and said instep cushion comprises one or more hollow cylinders of spongy material fitted coaxially onto said instep rest.

12. The apparatus of claim 1 further including risers situated under the lower ends of said vertical supports and under forward end of said rail.

* * * * *